US008226456B2

(12) United States Patent
Chang

(10) Patent No.: US 8,226,456 B2
(45) Date of Patent: Jul. 24, 2012

(54) POWER TOOL PACKING APPARATUS

(76) Inventor: Hsien-Lung Chang, Taipei (TW)

( * ) Notice: Subject to any disclaimer, the term of this patent is extended or adjusted under 35 U.S.C. 154(b) by 358 days.

(21) Appl. No.: 12/703,767

(22) Filed: Feb. 11, 2010

(65) Prior Publication Data

US 2011/0195642 A1 Aug. 11, 2011

(51) Int. Cl.
*B24B 23/00* (2006.01)

(52) U.S. Cl. ..... 451/344; 451/342; 451/340

(58) Field of Classification Search ..... 451/342, 451/344, 340; 192/15, 16, 28, 114 R, 114 T, 192/223.2; 411/432; 403/251, 24
See application file for complete search history.

(56) References Cited

U.S. PATENT DOCUMENTS 2,597,798 A * 5/1952 Houplain ..... 192/223.2
5,388,942 A * 2/1995 Bonacina et al. ..... 411/432
6,206,164 B1 * 3/2001 Kurita ..... 192/223.2
6,481,557 B2 * 11/2002 Denis ..... 192/223.2
7,220,091 B2 * 5/2007 Takahashi et al. ..... 411/432
7,455,574 B2 * 11/2008 Chu et al. ..... 451/342

FOREIGN PATENT DOCUMENTS

TW M333481 6/2008
TW M349437 1/2009

* cited by examiner

*Primary Examiner* — George Nguyen
(74) *Attorney, Agent, or Firm* — Muncy, Geissler, Olds & Lowe, PLLC

(57) ABSTRACT

A power tool packing apparatus provides a packing force to form a compact coupling between an application tool and an output shaft of a power tool. The packing apparatus comprises a pressing disk, a crank set, a movable wheel and a plurality of steel balls. The movable wheel and the pressing disk form a space between them to hold the steel balls. The crank set has a plurality of pins butting the steel balls. The pressing disk has a force applying surface butted by the steel balls in regular conditions so that the pressing disk provides a packing force butted outward in the regular conditions. The movable wheel has retraction notches. When the movable wheel is turned, the steel balls slide into the retraction notches to provide the pressing disk an inward retraction space, thereby the packing force is released and the application tool can be disassembled quickly.

6 Claims, 6 Drawing Sheets

POWER TOOL PACKING APPARATUS

FIELD OF THE INVENTION

The present invention relates to a power tool packing apparatus coupled on an output shaft of a power tool to provide a packing force to form compact coupling between the output shaft and an application tool fastened thereon.

BACKGROUND OF THE INVENTION

Myriad of power tools (including pneumatic or electric types) are available now on the market. In order to provide multiple functions through a single power tool, a removable power tool spared a distal end with a shaft to couple with varying types of application tools (such as grinding wheels, sleeves, etc.) has been developed to allow the power tool to change application tools to switch functions as desired. This creates a structural problem of assembling and disassembling the application tools. In the event that the application tools are not firmly assembled, operation safety becomes a great concern. However, a firmer installation and assembly structure often requires a greater effort to assemble or disassemble the application tools.

In order to provide a firmer fastening structure and fast disassembly of application tools, fast disassembling apparatus has been proposed in prior art. For instance, R.O.C. patent No. M333481 entitled "Fast assembling and disassembling fastening apparatus" comprising an outer ring, a clutch disk, a first spacer, a second spacer, a plurality of steel balls, a plurality of compression springs and a latch disk. The outer ring has an inner space in the center. The first spacer and second spacer are located in the inner space opposing to each other. The latch disk and clutch disk are coupled at two sides of the outer ring to clamp the first spacer and the second spacer. The first spacer has a plurality of first protruding portions. The second spacer has a plurality of second protruding portions. The steel balls are located between the first protruding portions and the second protruding portions. Each of the compression springs has two ends respectively butting the back side of the first and second protruding portions. The fastening apparatus is run through by an output shaft of a power tool. The output shaft has a distal end coupled with an application tool. The fastening apparatus provides a packing force to form a firm coupling between the output shaft and the application tool. The latch disk has a plurality of notches thereon. When the outer ring is turned by a user, the steel balls can be driven to drop into the notches to release the packing force among the clutch disk, latch disk and output shaft so that the user can quickly separate the output shaft and the application tool.

R.O.C. patent No. M349437 also discloses a similar technique. While they provide fast disassembling effect, they contain a great number of elements. Moreover, the first spacer, second spacer and compression springs form uneven forces during assembly that make assembly difficult. More assembly time is needed and element costs also are higher.

SUMMARY OF THE INVENTION

In view of the problems occurred to the conventional fast disassembling apparatus of power tools such as containing too many elements and higher costs, the primary object of the present invention is to provide a novel fast disassembling apparatus that has a simpler structure to reduce assembly time and cost and facilitate faster production at a lower cost.

The present invention provides a power tool packing apparatus run through by an output shaft of a power tool. The output shaft has a distal end coupled with an application tool. The packing apparatus provides a packing force to form compact coupling between the application tool and the output shaft. The packing apparatus comprises a pressing disk, a crank set, a movable wheel and a plurality of steel balls. The pressing disk has an engaging surface in contact with the application tool and a force applying surface on another side opposite to the engaging surface. The pressing disk has an orifice in the center. The crank set has a sleeve run through by a output shaft and a plurality of pins extended radially. The sleeve runs through the orifice and is coupled with the crank set and pressing disk. The movable wheel has a plurality of anchor troughs, a plurality of pin movable notches, a plurality of spring holding troughs and a plurality of retraction notches abutting the anchor troughs. The steel balls are held in the anchor troughs between the movable wheel and the force applying surface of the pressing disk. The pins pass through the pin movable notches. The compression springs held in the spring holding troughs provide an elastic force to confine the steel balls between the anchor troughs and the pins so that the steel balls provide the packing force to compact tightly the force applying surface. When the movable wheel is turned by a user, the steel balls slide into the retraction notches away from the force applying surface to provide an inward retraction space for the pressing disk, therefore the packing force on the pressing disk is released.

By means of the construction set forth above, a compact relationship between the output shaft and the application tool can be formed through the pressing disk. By turning the movable wheel, the steel balls can be moved in a skewed manner so that the pressing disk can be retracted to release the packing force between the output shaft and the application tool. As a result, fast disassembly can be accomplished.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
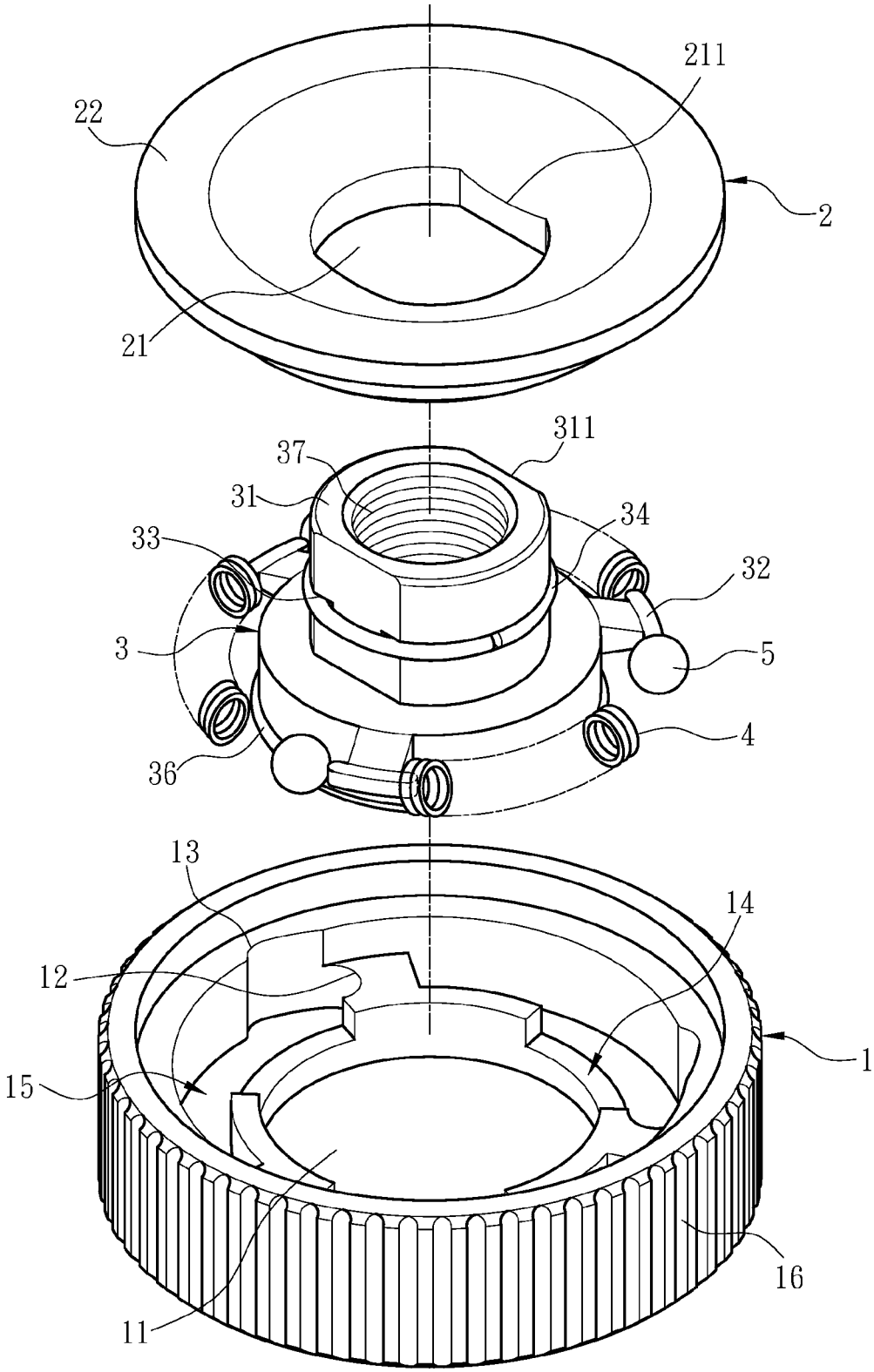
FIG. 1 is an exploded view of the invention.
Figure 2:
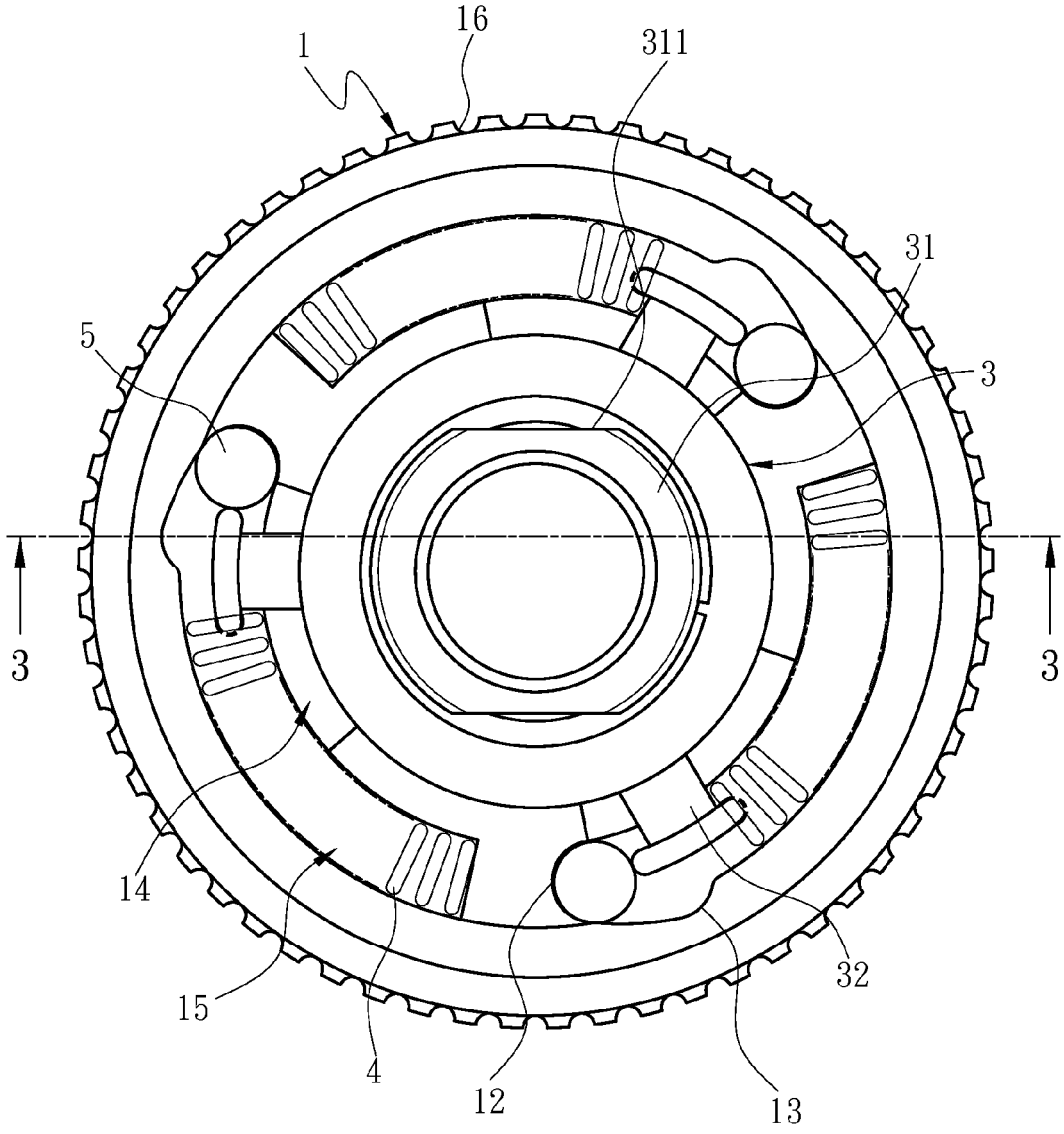
FIG. 2 is a schematic top view of the movable wheel and the crank set in a coupled condition.
Figure 3:
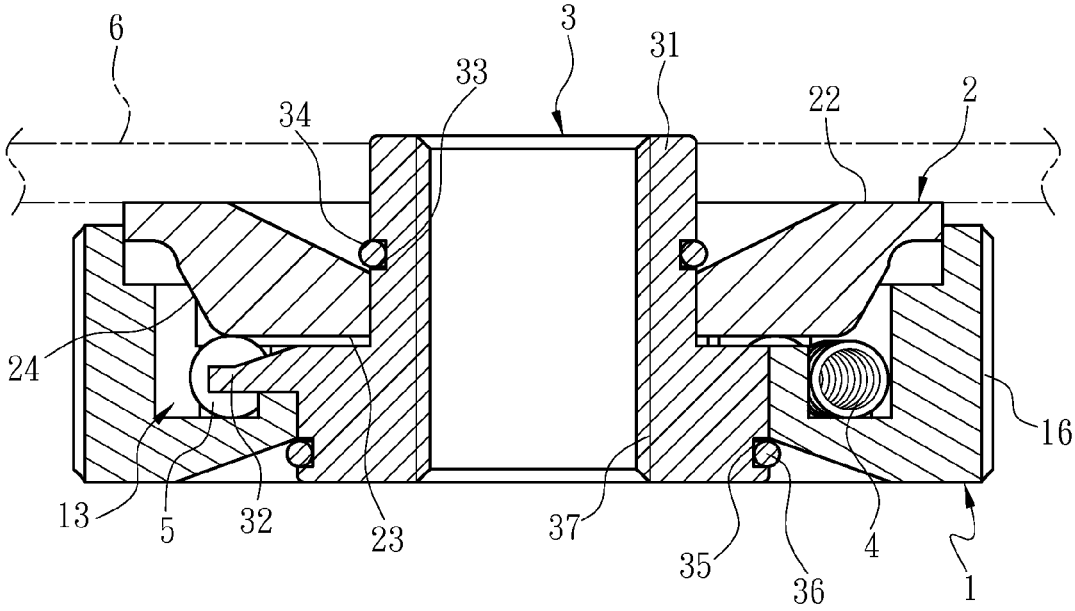
FIG. 3 is a sectional view taken on line 3-3 in FIG. 2.
Figure 6:
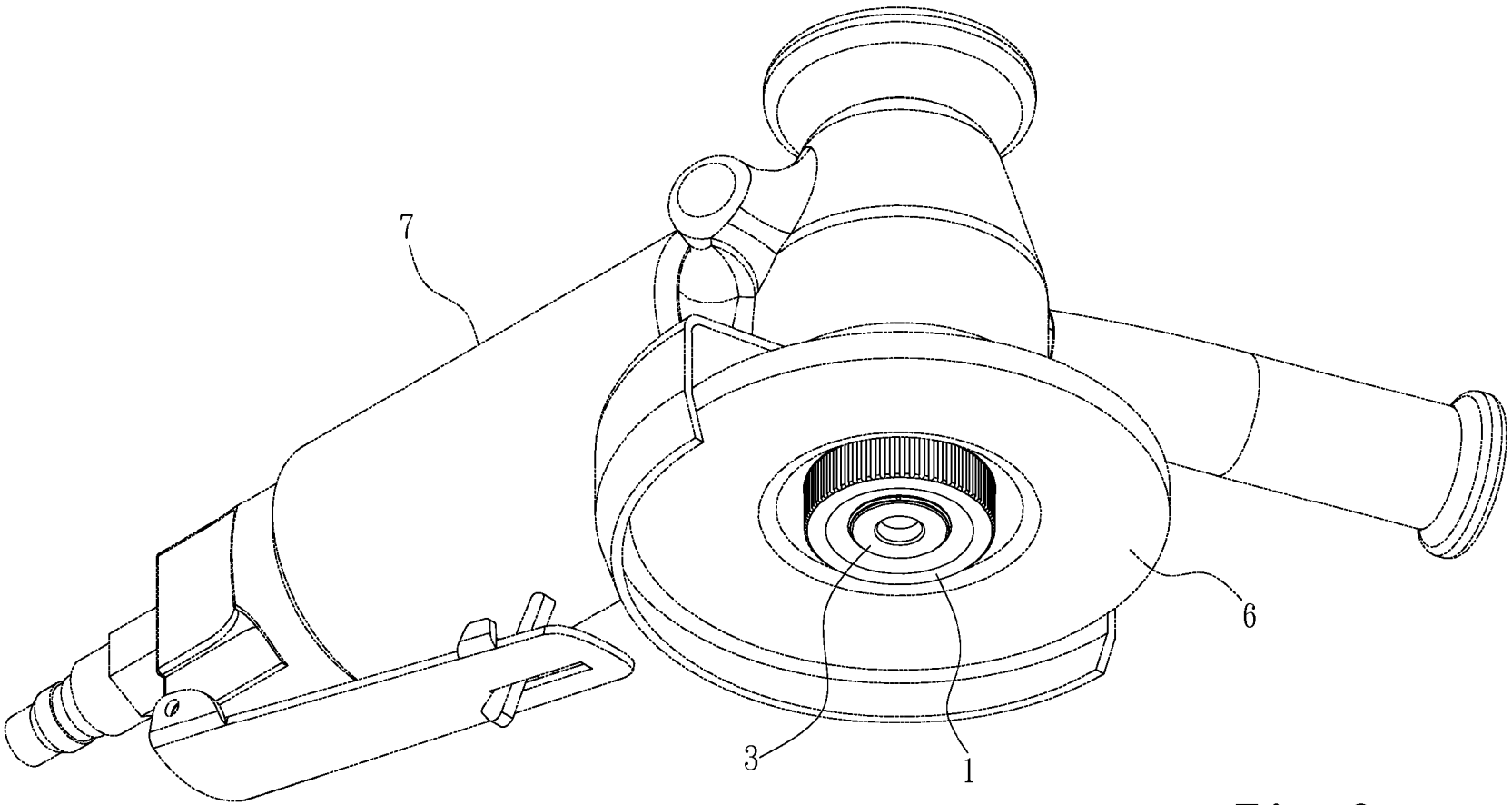
FIG. 6 is a schematic view of the packing apparatus and a power tool in a coupled condition.

Please refer to FIGS. 1, 2, 3 and 6, the present invention provides a packing apparatus run through by an output shaft (not shown in the drawings) of a power tool 7 (as shown in FIG. 6). The power tool 7 may be pneumatic or electric. The output shaft has a distal end connected to an application tool. The packing apparatus provides a packing force to form compact coupling between the application tool and the output shaft. The packing apparatus comprises a movable wheel 1, a pressing disk 2, a crank set 3, a plurality of compression springs 4 and a plurality of steel balls 5. The pressing disk 2 has an engaging surface 22 in contact with the application tool and a force applying surface 23 on another side opposite to the engaging surface 22. The pressing disk 2 has an orifice 21 in the center. The crank set 3 has a sleeve 31 run through by the output shaft and a plurality of pins 32 extended radially. The sleeve 31 has an inner edge with a screw thread 37 formed thereon to be screwed with the output shaft. The sleeve 31 runs through the orifice 21 and is coupled with the crank set 3 and pressing disk 2. The sleeve 31 has at least one section surface 311. The orifice 21 on the pressing disk 2 has at least one section inner edge 211 mating the sleeve 31. The movable wheel 1 has an opening 11 run through by the crank set 3, a plurality of anchor troughs 12, a plurality of retraction notches 13 abutting the anchor troughs 12, a plurality of pin movable notches 14, and a plurality of spring holding troughs 15. The crank set 3 is held in the opening 11 of the movable wheel 1. The pins 32 are held in the pin movable notches 14. The steel balls 5 are held in the anchor troughs 12 between the movable wheel 1 and the force applying surface 23 of the pressing disk 2. The pins 32 pass through the pin movable notches 14 abutting the steel balls 5. The compression springs 4 are held in the spring holding troughs 15. Each of the compression springs 4 has one end butting the spring holding trough 15 and the other end butting the pin 32 to provide an elastic force to confine the steel ball 5 between the anchor trough 12 and the pin. The pins 32 and anchor troughs 12 are equally spaced on the crank set 3 and movable wheel 1. Referring to FIG. 3, the steel balls 5 in the anchor troughs 12 have outer edges butting the force applying surface 23. Hence the pressing disk 2 has no retraction room. The output shaft runs through the sleeve 31 to couple with an application tool as shown in FIGS. 3 and 6. In an embodiment, the application tool is a grinding disk 6. The engaging surface 22 of the pressing disk 2 is in contact with the grinding disk 6. Since the pressing disk 2 is butted by the steel balls 5, when the output shaft is coupled with the grinding disk 6, the pressing disk 2 provides a packing force to push the grinding disk 6 to form a compact coupling between the output shaft and the grinding disk 6. The structure previously discussed has fewer elements, and is simpler and can be produced at a lower cost. Assembly also is easier. In addition to the foregoing structure, other options may also be provided, such as the movable wheel 1 may have traces 16 formed on the lateral surface to facilitate grasping by the user. The traces 16 provide friction to turn the movable wheel 1. The pressing disk 2 also has a sloped surface 24 extended outwards radially at a gradual shrinking thickness and connected to the force applying surface 23. The sloped surface 24 is perpendicular to the retraction notches 13. The purpose of the sloped surface 24 will be discussed later. Moreover, the crank set 3 has a first groove 33 and a second groove 35 that are coupled respectively with a ring 34 and 36. The rings 34 and 36 latch respectively on an upper side of the pressing disk 2 and a lower side of the movable wheel 1 to securely confine the crank set 3 on the movable wheel 1.

Figure 4:
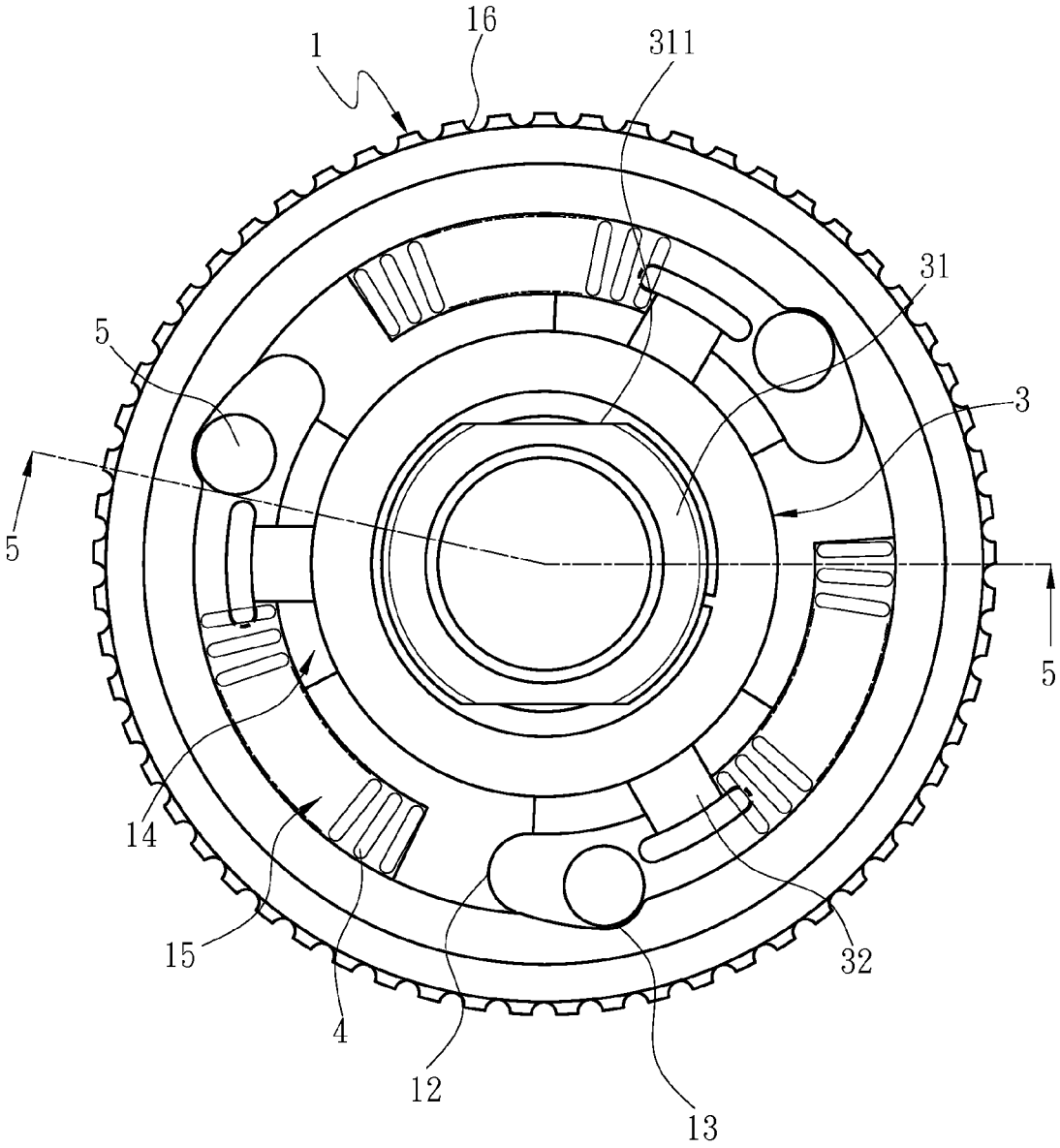
FIG. 4 is a sectional view showing the steel balls dropped in the retraction notches.
Figure 5:
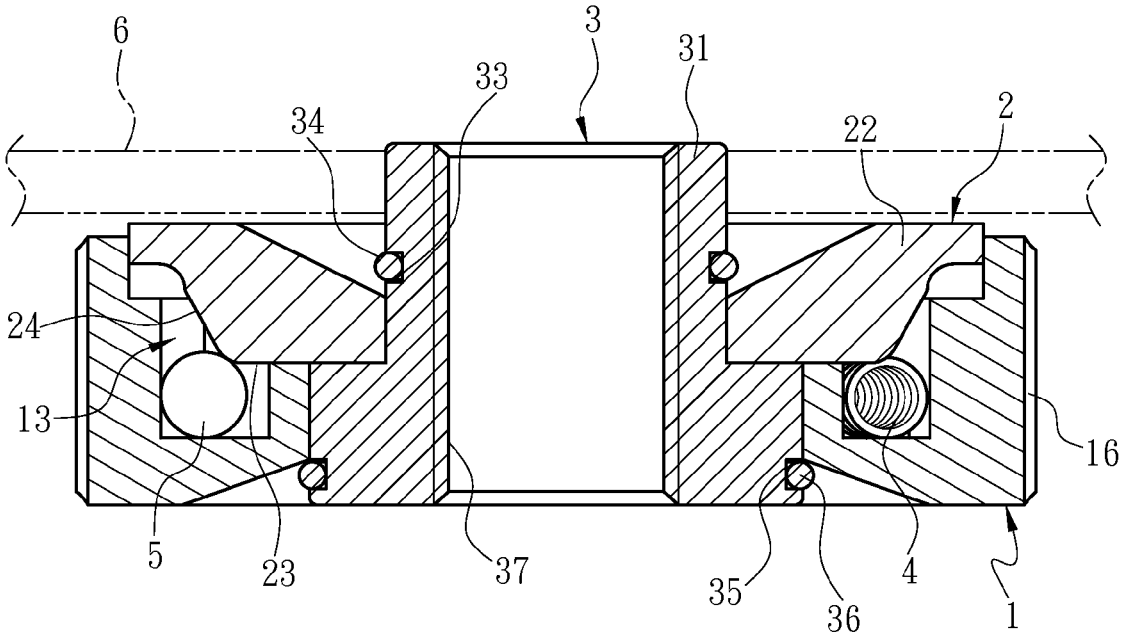
FIG. 5 is a sectional view taken on line 5-5 in FIG. 4.

Referring to FIGS. 4 and 5, when it is desired to loosen the packing apparatus to disassemble the application tool, turn the movable wheel 1; as the crank set 3 is fastened to the output shaft through the screw thread 37, and the crank set 3 and the pressing disk 2 are engaged with the section inner edge 211 of the orifice 21 through the section surface 311 of the sleeve 31, such that the crank set 3 and the pressing disk 2 are anchored and rotate synchronously with the output shaft. The movable wheel 1 rotates relative to the crank set 3 and the pressing disk 2. The steel balls 5 move away from the anchor troughs 12 and slide gradually towards the retraction notches 13; meanwhile, the compression springs 4 are compressed. When the steel balls 5 slide into the retraction notches 13, the widest circumference of the steel balls 5 deviates from the force applying surface 23. As the sloped surface 24 of the pressing disk 2 is perpendicular to the retraction notches 13, after the steel balls 5 have slid into the retraction notches 13, a greater retraction room is formed. Hence when the movable wheel 1 is turned, the pressing disk 2 releases the packing force on the application tool, and the application tool can be disassembled quickly. When the movable wheel 1 is loosened, the elastic force of the compression springs 4 returns the movable wheel 1 to its original position. Thus the present invention provides a significant improvement over the conventional techniques.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A power tool packing apparatus run through by an output shaft of a power tool, the output shaft including a distal end connected to an application tool, the packing apparatus providing a packing force to form a compact coupling between the application tool and the output shaft, and the packing apparatus comprising:

a pressing disk including an engaging surface in contact with the application tool, a force applying surface on another side opposite to the engaging surface, and an orifice in the center;

a crank set including a sleeve run through by the output shaft and a plurality of pins extended radially, the sleeve running through the orifice to couple with the crank set and the pressing disk;

a movable wheel and a plurality of steel balls, the movable wheel including an opening run through by the crank set for coupling therewith, a plurality of anchor troughs, a plurality of pin movable notches, a plurality of spring holding troughs and a plurality of retraction notches abutting the anchor troughs; the steel balls being held in the anchor troughs between the movable wheel and the force applying surface of the pressing disk, the pins running through the pin movable notches, the spring holding troughs holding a plurality of compression springs which provide elastic forces to confine the steel balls between the anchor troughs and the pins so that the steel balls provide a packing force on the force applying surface such that when the movable wheel is turned by a user, the steel balls slide into the retraction notches and move away from the force applying surface to provide the pressing disk an inward retraction room.

2. The power tool packing apparatus of claim 1, wherein the pressing disk includes a sloped surface which is extended outwards radially at a gradual shrinking thickness and connected to the force applying surface, the sloped surface being perpendicular to the retraction notches to increase the inward retraction room of the pressing disk.

3. The power tool packing apparatus of claim 1, wherein the pins and the anchor troughs are formed in an equally spaced manner.

4. The power tool packing apparatus of claim 1, wherein the sleeve includes at least one section surface and the pressing disk including at least one section inner edge on the orifice mating the sleeve.

5. The power tool packing apparatus of claim 1, wherein the movable wheel includes traces on the lateral surface to facilitate grasping of the user.

6. The power tool packing apparatus of claim 1, wherein the crank set includes a first groove and a second groove that are coupled respectively with a ring to latch respectively on an upper side of the pressing disk and a lower side of the movable wheel.

* * * * *